US010731616B2

(12) United States Patent
Kodama et al.

(10) Patent No.: US 10,731,616 B2
(45) Date of Patent: Aug. 4, 2020

(54) HIGH-PRESSURE FUEL SUPPLY PUMP

(71) Applicant: HITACHI AUTOMOTIVE SYSTEMS, LTD., Ibaraki (JP)

(72) Inventors: Yuitsu Kodama, Hitachinaka (JP); Yukihiro Yoshinari, Hitachinaka (JP); Kenichiro Tokuo, Hitachinaka (JP); Yuuki Takahashi, Hitachinaka (JP)

(73) Assignee: Hitachi Automotive Systems Ltd., Ibaraki (JP)

( * ) Notice: Subject to any disclaimer, the term of this patent is extended or adjusted under 35 U.S.C. 154(b) by 0 days.

(21) Appl. No.: 16/330,890

(22) PCT Filed: Aug. 2, 2017

(86) PCT No.: PCT/JP2017/027988
§ 371 (c)(1),
(2) Date: Mar. 6, 2019

(87) PCT Pub. No.: WO2018/061471
PCT Pub. Date: Apr. 5, 2018

(65) Prior Publication Data

US 2019/0211788 A1 Jul. 11, 2019

(30) Foreign Application Priority Data

Sep. 28, 2016 (JP) ..... 2016-188990

(51) Int. Cl.
*F02M 59/36* (2006.01)
*F02M 59/34* (2006.01)

(52) U.S. Cl.
CPC ..... *F02M 59/366* (2013.01); *F02M 59/34* (2013.01); *F02M 59/36* (2013.01)

(58) Field of Classification Search
CPC ..... F02M 59/366; F02M 59/34; F02M 59/46; F02M 59/368; F02M 59/466;
(Continued)

(56) References Cited

U.S. PATENT DOCUMENTS

2014/0099215 A1 4/2014 Kawano et al.
2014/0348676 A1* 11/2014 Kato ..... F04B 1/0452 417/437

(Continued)

FOREIGN PATENT DOCUMENTS

JP 2005-139953 A 6/2005
JP 2012-251447 A 12/2012

(Continued)

OTHER PUBLICATIONS

International Search Report for WO 2018/061471 A1.
Extended European Search Report dated Apr. 17, 2020 for the European Patent Application No. 17855429.1.

*Primary Examiner* — George C Jin
(74) *Attorney, Agent, or Firm* — Volpe and Koenig, P.C.

(57) ABSTRACT

A high-pressure fuel supply pump comprising a suction valve disposed on a suction side of a pressurizing chamber, an engagement member having a protrusion part that protrudes toward the outer periphery and biasing the suction valve by use of the force of a spring, a stator for generating a magnetic attraction force, and a plunger drawn by the magnetic attraction force and driving the engagement member toward the stator by engaging with the protrusion part, the fuel supply pump being configured so that the area of the fuel passage is smallest between the outer periphery of the protrusion part and the inner periphery of the plunger, and so that a tapered section whereby the area of the flow path increases from the portion where the area of the passage is smallest toward the pressurizing chamber or toward the suction valve side is formed.

11 Claims, 11 Drawing Sheets

(58) Field of Classification Search
CPC ..... F02M 59/485; F02M 59/243; F02M 63/0025; F02M 63/0075
See application file for complete search history.

(56) References Cited

U.S. PATENT DOCUMENTS

| | | | | |
|---|---|---|---|---|
| 2015/0159638 | A1* | 6/2015 | Saito | B60T 8/442 417/540 |
| 2017/0248110 | A1 | 8/2017 | Hashida et al. | |
| 2019/0093615 | A1* | 3/2019 | Erdemir | F02M 59/34 |

FOREIGN PATENT DOCUMENTS

| | | | |
|---|---|---|---|
| JP | 2015-190532 | A | 11/2015 |
| JP | 2016-094913 | A | 5/2016 |
| JP | 2016-142143 | A | 8/2016 |
| WO | 2016/031378 | A1 | 3/2016 |

* cited by examiner

HIGH-PRESSURE FUEL SUPPLY PUMP

TECHNICAL FIELD

The present invention relates to a high-pressure fuel supply pump that pumps fuel to a fuel injection valve of an internal combustion engine, and particularly relates to a high-pressure fuel pump including an electromagnetic suction valve that adjusts an amount of fuel to be discharged.

BACKGROUND ART

There is a widely used high-pressure fuel supply pump including an electromagnetic suction valve that increases a fuel pressure and discharges fuel at a desired flow rate in a direct injection type internal combustion to directly inject the fuel into a combustion chamber among internal combustion engines of an automobile and the like. For example, PTL 1 (JP 2012-251447 A) below discloses, as a next generation high-pressure fuel pump, a structure in which an anchor and a rod are formed in separate bodies.

CITATION LIST

Patent Literature

PTL 1: JP 2012-251447 A

SUMMARY OF INVENTION

Technical Problem

In a high-pressure fuel supply pump of PTL 1, the inside of a solenoid section is filled with fuel due to structures of components in the solenoid section. Accordingly, movement of a movable element causes flow separation in the vicinity of a protrusion part of an engagement member inside a fuel path, and cavitation tends to occur.

Solution to Problem

In the view of the above-described problem, a high-pressure fuel pump of the present invention includes: a suction valve provided on a suction side of a pressurizing chamber; an engagement member having a protrusion part which protrudes toward an outer periphery side and biases the suction valve by use of force of a spring; a stator which generates magnetic attraction force; and a movable element which is sucked by the magnetic attraction force and drives the engagement member toward the stator by being engaged with the protrusion part, in which path area of a fuel path between an outer periphery part of the protrusion part and an inner periphery part of the movable element is formed smallest, and further provided is a tapered section which broadens the flow passage area toward the pressurizing chamber side or toward the suction valve side from a portion having the smallest path area.

Advantageous Effects of Invention

According to the present invention having the above-described structure, a flow separation region in the vicinity of the protrusion part of the engagement member can be reduced, thereby contributing to suppression of cavitation.

DESCRIPTION OF EMBODIMENTS

Embodiments of the present invention will be described below with reference to the drawings.

First Embodiment

Figure 1:
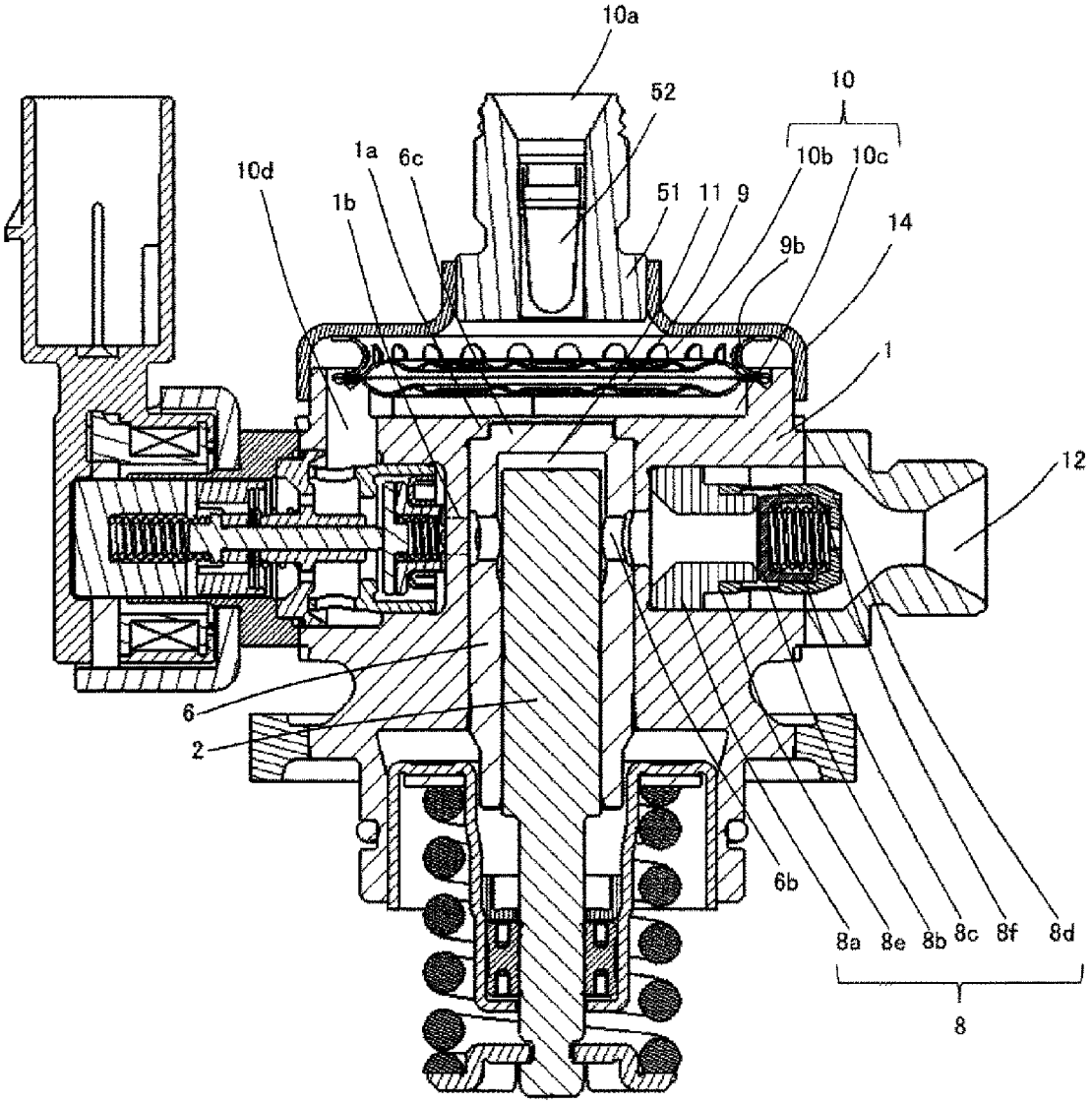
FIG. 1 is a longitudinal cross-sectional view of a high-pressure fuel supply pump according to a first embodiment and a second embodiment of the present invention.
Figure 8:
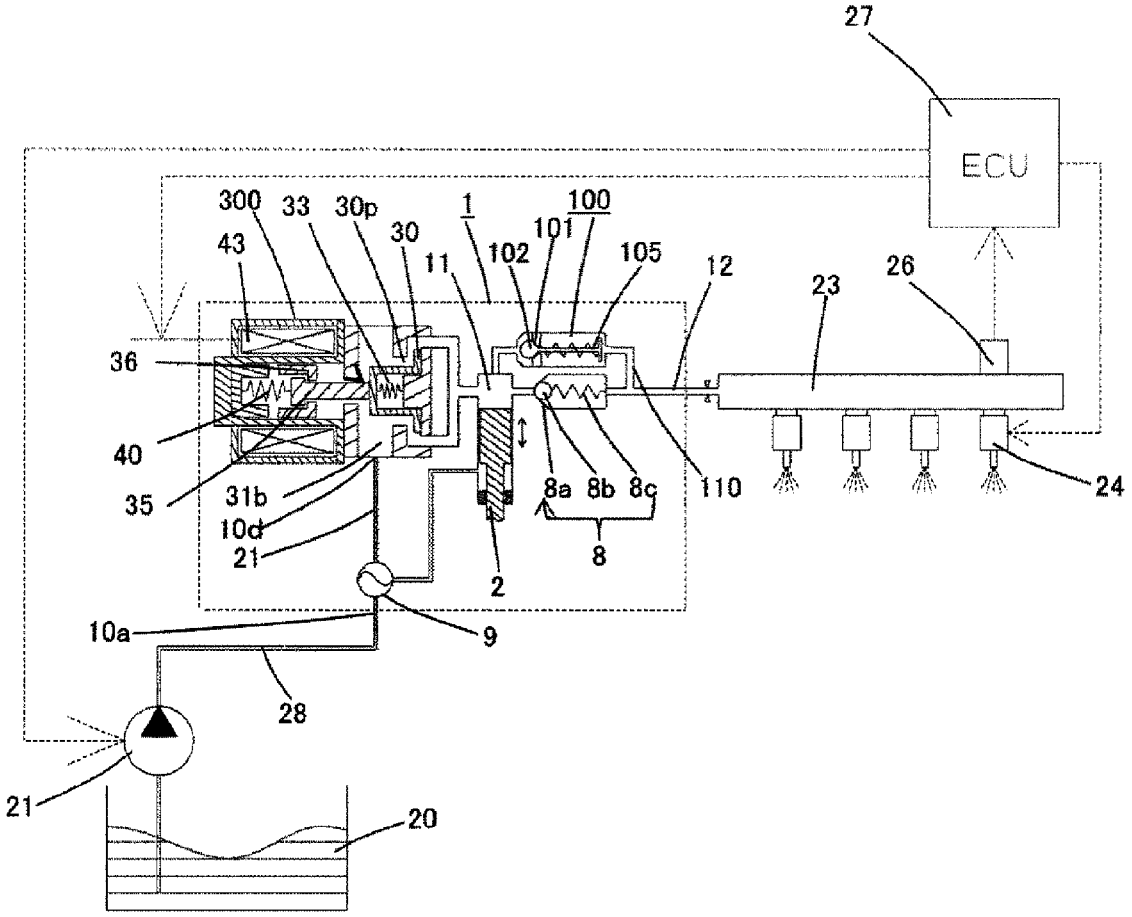
FIG. 8 is an exemplary diagram of a fuel supply system including the high-pressure fuel supply pump according to the first embodiment and the second embodiment of the present invention.

A structure and operation of a system will be described with reference to a longitudinal cross-sectional view of a high-pressure fuel supply pump in FIG. 1 and an entire structure diagram of the system illustrated in FIG. 8. In FIG. 8, a part surrounded by a broken line indicates a main body of the high-pressure fuel supply pump (hereinafter referred to as a high-pressure pump), and mechanisms and components illustrated inside this broken line are integrally incorporated in the high-pressure pump main body 1.

Fuel inside a fuel tank 20 is pumped up by a feed pump 21 based on a signal from an engine control unit 27 (hereinafter referred to as an ECU), the fuel is pressurized up to an appropriate feed pressure and fed to a low-pressure fuel suction port 10*a* of the high-pressure pump through a suction pipe 28. The fuel having passed through the suction joint 10*a* reaches a suction port 31*b* of an electromagnetic suction valve 300 constituting a capacity variable mechanism via a pressure pulsation reduction mechanism 9 and a suction path 10*d*.

The fuel having flown into the electromagnetic suction valve 300 passes through a suction valve 30 and flows into a pressurizing chamber 11. Power is applied to a plunger 2 by a cam mechanism of an engine such that the plunger can perform reciprocating motion, and the fuel is sucked from the suction valve 30 by the reciprocating motion of the plunger 2 in a descending step of the plunger 2. Additionally, the fuel is pressurized in an ascending step of the plunger 2. When a fuel pressure in the pressurizing chamber 11 becomes higher than a fuel pressure in a discharge path 12 in this ascending stroke, a discharge valve 8 is opened. Then, the fuel is pumped, through the discharge valve 8, to a common rail 23 on which a pressure sensor 26 is mounted. The high-pressure fuel in the common rail 23 is injected to the engine by an injector 24 based on a signal from the ECU 27.

The high-pressure pump discharges the fuel at a flow rate so as to achieve desired supplied fuel in accordance with a signal from the ECU 27 to the electromagnetic suction valve. A relief valve 100 is provided in order to prevent an abnormal high pressure, and when the fuel pressure in the common rail 23 or the discharge path 12 is increased to an abnormal high pressure of a setting pressure of the relief valve 100 or higher, the relief valve 100 is opened. Consequently, the fuel in the common rail 23 or the discharge path 12 is returned into the pressurizing chamber 11 of the high-pressure pump, thereby preventing an abnormal high-pressure state in the common rail.

The pump main body 1 is further provided with a relief path 110 which bypasses a discharge valve 8*b* and allows communication between the pressurizing chamber 11 and the discharge path 12 on a downstream side of the discharge valve. The relief path 110 is provided with a relief valve 102 to limit, to only one direction, a flow of the fuel from the discharge path 12 to the pressurizing chamber 11. The relief valve 102 is pressed against a relief valve seat 101 by a relief spring 105 that generates pressing force, and when a pressure difference between the inside of the pressurizing chamber 11 and the inside of the relief path 110 becomes a setting pressure or higher, the relief valve 102 is set so as to be separated from the relief valve seat 101 and opened.

In a case where the common rail 23 has an abnormal high pressure due to malfunction of the electromagnetic suction valve 300 of the high-pressure pump or the like, the relief valve 102 is opened when a pressure difference between the pressurizing chamber 11 and the relief path 110 communicating with the discharge path 12 becomes a valve opening pressure of the relief valve 102 or higher. Consequently, the fuel having the abnormal high pressure in the discharge path 12 is returned from the relief path 110 to the pressurizing chamber 11, and the high-pressure side pipe such as the common rail 23 is protected.

Figure 2:
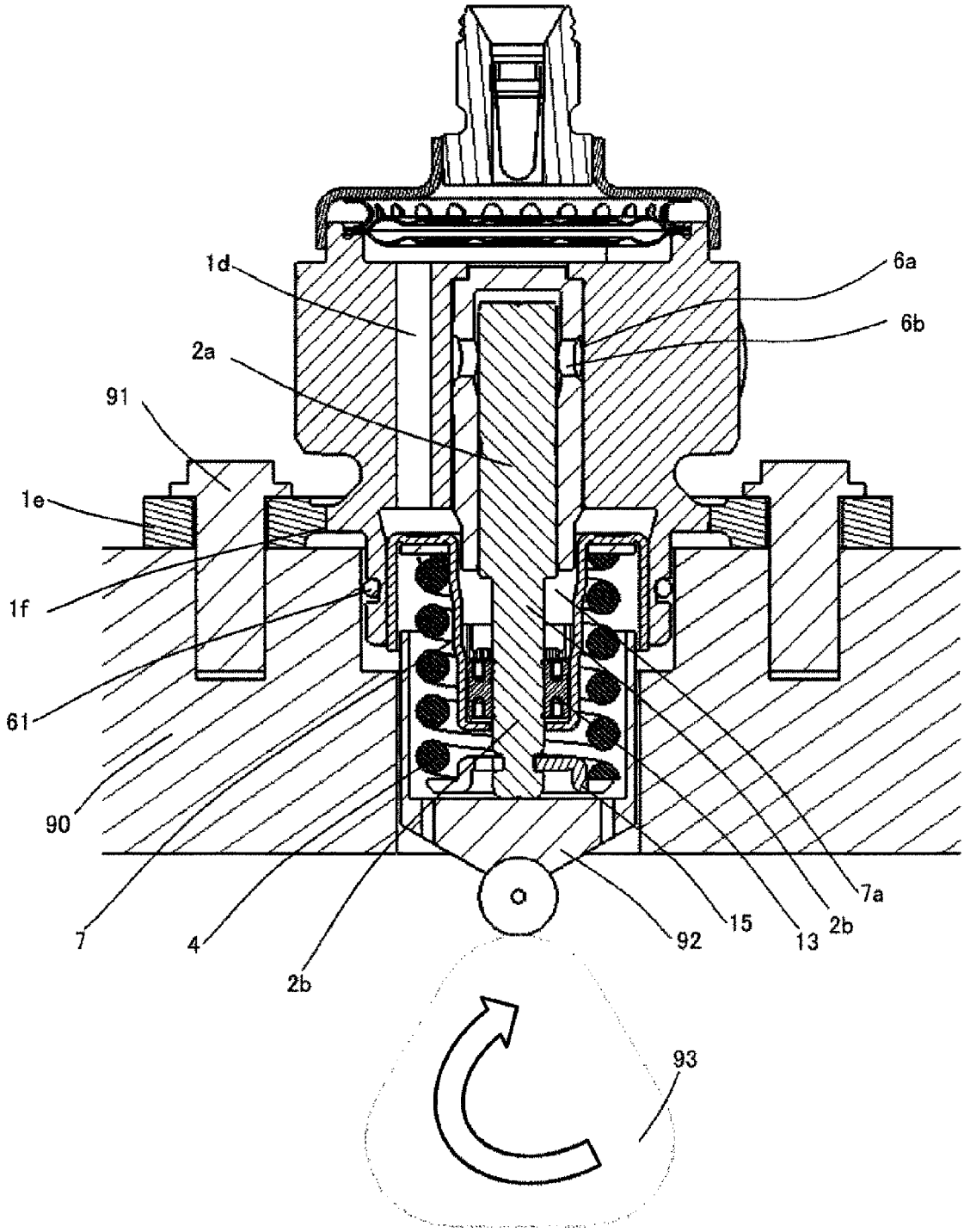
FIG. 2 is another longitudinal cross-sectional view of the high-pressure fuel supply pump according to the first embodiment and the second embodiment of the present invention, and also is the cross-sectional view illustrating installation in an engine.

The structure and operation of the high-pressure pump will be described with reference to FIGS. 1, 2 and 8.

Generally, in a high-pressure pump, a flange 1*e* provided in the pump main body 1 airtightly contacts a flat surface of a cylinder head 90 of an internal combustion engine, and is fixed with a plurality of bolts 91. The installed flange 1*e* is joined by welding to an entire circumference of the pump main body 1 at welding part 1*f* and forms an annular fixing part. In present embodiment, laser welding is used.

An O-ring 61 is fitted to the pump main body 1 in order to provide a sealing between cylinder head 90 and the pump main body 1 and prevents leakage of engine oil to the outside. In the pump main body 1, a cylinder 6 is installed to guide the reciprocating motion of the plunger 2, and the cylinder has an end part formed in a bottomed cylinder shape so as to form a pressurizing chamber 11 inside thereof. Additionally, the pressurizing chamber 11 is provided with an annular groove 6*a* on an outer periphery side and a plurality of communication holes 6*b* to provide communication between the annular groove and the pressurizing chamber so as to provide communication with the electromagnetic suction valve 300 adapted to supply the fuel and the discharge valve mechanism 8 adapted to discharge the fuel to the discharge path from the pressurizing chamber 11.

The cylinder 6 has an outer diameter press-fitted to the pump main body 1 to provide a sealing with a press-fitted cylindrical surface so as to prevent leakage of the pressurized fuel to a low-pressure side from a gap with the pump main body 1. Additionally, the cylinder 6 has a small diameter part 6*c* located at the outer diameter of the cylinder 6 on the pressurizing chamber side, and when the fuel in the pressurizing chamber 11 is pressurized, the cylinder 6 is applied with force toward a low-pressure fuel chamber 10*c* side, but since a small diameter part 1*a* is provided in the pump main body 1, the cylinder 6 is prevented from coming out to the low-pressure fuel chamber 10*c* side. Since mutual surfaces of the pump main body 1 and the cylinder 6 planarly contact in an axial direction, a double sealing function is exerted in addition to the above-described sealing at the contacting cylindrical surface between the components.

The plunger 2 has a lower end provided with a tappet 92 that converts a rotational motion of a cam installed at a camshaft of the internal combustion engine into an up-down motion and transmits the up-down motion to the plunger 2. The plunger 2 is pressure-bonded to the tappet 92 by a spring 4 via a retainer 15. Consequently, the plunger 2 can reciprocate up and down along with the rotational motion of a cam 93.

Additionally, a plunger seal 13 held at a lower end part of an inner periphery of a seal holder 7 is installed in a state slidably contacting an outer periphery of the plunger 2 at a lower part of the cylinder 6 in the drawing, and it is possible to achieve a sealable structure in which the fuel in a low-pressure chamber 7*a* can be sealed and prevented from leaking to the outside even in a case where the plunger 2 slides. At the same time, lubrication oil (including engine oil) that lubricates a sliding part inside the internal combustion engine is prevented from flowing into the pump main body 1.

A damper cover 14 is fixed at a head part of the pump main body 1. The damper cover 14 is provided with a suction joint 51 and forms the low-pressure fuel suction port 10*a*. The fuel having passed through the low-pressure fuel suction port 10*a* passes through a filter 52 fixed inside the suction joint 51 and reaches the suction port 31*b* of the electromagnetic suction valve 300 via the pressure pulsation reduction mechanism 9 and the low-pressure fuel flow passage 10*d*.

The suction filter 52 inside the suction joint 51 functions to prevent a foreign matter existing in a space from the fuel tank 20 to the low-pressure fuel suction port 10*a* from being absorbed into the high-pressure fuel supply pump by the flow of fuel.

The plunger 2 has a large diameter part 2*a* and a small diameter part 2*b*. When the plunger 2 reciprocates using the large diameter part 2*a* and the small diameter part 2*b*, the volume of the annular low-pressure fuel chamber 7*a* is increased or decreased. As for an increased/decreased amount of the volume, since the communication with low-pressure fuel chamber 10 is provided by a fuel path 1*d*, a flow of the flow is generated from the annular low-pressure fuel chamber 7*a* to the low-pressure fuel chamber 10 when the plunger 2 descends, and a flow of the fuel is generated from the low-pressure fuel chamber 10 to the annular low-pressure fuel chamber 7*a* when the plunger ascends. Due to this, a flow rate of the fuel to the inside/outside of the pump can be reduced in a suction step or a return step of the pump, and a function to reduce pulsation is provided.

The low-pressure fuel chamber 10 is provided with the pressure pulsation reduction mechanism 9 that reduces pressure pulsation generated inside the high-pressure pump from being spread to the fuel pipe 28. In a case where the fuel once having flown into the pressurizing chamber 11 is returned to the suction path 10*d* (suction port 31*b*) through the suction valve body 30 in an open state for capacity control, pressure pulsation is generated in the low-pressure fuel chamber 10 by the fuel that has been returned to the suction path 10*d* (suction port 31*b*). However, the pressure pulsation reduction mechanism 9 provided in the low-pressure fuel chamber 10 is formed of a metal damper obtained by bonding outer peripheries of two pieces of corrugated disk-shaped metal plates each other and injecting an inert gas such as argon into the inside thereof, and the pressure pulsation is absorbed and reduced by expansion/contraction of this metal damper. Since reference sign 9*b* represents a fixing bracket to fix the metal damper to an inner periphery part of the pump main body 1 and is installed on the fuel path, a plurality of holes is provided such that fluid can be freely moved to a front side and back side of the fixing bracket 9*b*.

The discharge valve mechanism 8 is provided at an exit of the pressurizing chamber 11. The discharge valve mechanism 8 includes: a discharge valve seat 8*a;* a discharge valve 8*b* that contacts and is separated from the discharge valve seat 8*a;* a discharge valve spring 8*c* that biases the discharge valve 8*b* against the discharge valve seat 8*a;* and a discharge valve holder 8*d* housing the discharge valve 8*b* and the discharge valve seat 8*a,* in which the integral discharge valve mechanism 8 is formed by joining the discharge valve seat 8*a* and the discharge valve holder 8*d* at an abutment part Se by welding.

Meanwhile, the inside of the discharge valve holder 8*d* is provided with a stepped part 8*f* forming a stopper to regulate stroking of the discharge valve 8*b*. In a state where there is no fuel pressure difference between the pressurizing chamber 11 and the fuel discharge port 12, the discharge valve 8*b* is in a closed state by being pressed against the discharge valve seat 8*a* by the biasing force of the discharge valve spring 8*c*. When the fuel pressure in the pressurizing chamber 11 becomes higher than the fuel pressure in the fuel discharge port 12, the discharge valve 8*b* is opened opposing to the discharge valve spring 8*c,* and the fuel inside the pressurizing chamber 11 is discharged with high pressure to the common rail 23 through the fuel discharge port 12. When the discharge valve 8*b* is opened, the discharge valve 8*b* contacts the discharge valve stopper 8*f,* and the stroking thereof is regulated.

Therefore, stroking of the discharge valve 8*b* is appropriately determined by the discharge valve stopper 8*d*. Consequently, the fuel that has been discharged with high pressure to the fuel discharge port 12 can be prevented from flowing back into the pressurizing chamber 11 again when the stroking is excessively large and the discharge valve 8*b* is closed delayed, and it is possible to suppress decrease in efficiency of the high-pressure pump. Additionally, while the discharge valve 8*b* is repeatedly opened and closed, the discharge valve 8*b* is guided on an inner periphery surface of the discharge valve holder 8*d* so as to be moved only in a stroking direction. With the above-described structure, the discharge valve mechanism 8 functions as a check valve to regulate a flowing direction of the fuel.

With the above-described constituent elements, the pressurizing chamber 11 includes the pump housing 1, electromagnetic suction valve 300, plunger 2, cylinder 6, and discharge valve mechanism 8. When the plunger 2 is moved in a direction of the cam 93 by the rotation of the cam 93 and is in a state of the suction step, the volume of the pressurizing chamber 11 is increased and the fuel pressure inside the pressurizing chamber 11 is decreased. When the fuel pressure inside the pressurizing chamber 11 becomes lower than a pressure in the suction path 10*d* in this step, the fuel passes through the suction valve 30 that is in an open state, passes through the communication hole 1*b* provided in the pump main body 1, passes through the cylinder outer peripheral path 6*a,* and flows into the pressurizing chamber 11.

After the plunger 2 terminates the suction step, plunger 2 proceeds to compression step. Here, an electromagnetic coil 43 is kept in a non-energized state and is not applied with magnetic biasing force. Therefore, the suction valve 30 remains opened by biasing force of a rod biasing spring 40. The volume of the pressurizing chamber 11 is reduced along with compressing motion of the plunger 2, but the pressure of the pressurizing chamber is not increased in this state because the fuel once sucked into the pressurizing chamber 11 is returned to the suction path 10*d* again through the suction valve 30 that is in the opened state again. This step will be referred to as a return step.

In this state, when a control signal from the engine control unit 27 (hereinafter referred to as ECU) is applied to the electromagnetic suction valve 300, current flows through the electromagnetic coil 43, and a rod 35 is moved in a direction away from the suction valve 30 by magnetic biasing force, and the suction valve 30 is closed by biasing force of a suction valve biasing spring 33 and fluid force generated by the fuel flowing into the suction path 10*d*. After the suction valve is closed, the fuel pressure in the pressurizing chamber 11 is increased along with the ascending motion of the plunger 2, and when the fuel pressure becomes a pressure in the fuel discharge port 12 or higher, the fuel is discharged with high pressure via the discharge valve mechanism 8 and supplied to the common rail 23. This step will be referred to as a discharge step.

In other words, the compression step of the plunger 2 (ascending step from a lower start point to an upper start point) includes the return step and the discharge step. Additionally, an amount of high-pressure fuel to be discharged can be controlled by controlling energization timing to the coil 43 from the electromagnetic suction valve 300. When the energization timing to the electromagnetic coil 43 is made earlier, a ratio of the return step becomes small and a ratio of the discharge step becomes large during the compression step. In other words, the amount of the fuel returned to the suction path 10*d* is reduced, and the amount of the fuel discharged with the high pressure is increased. On the other hand, when the energization timing is delayed, the ratio of the return step becomes large and the ratio of the discharge step becomes small during the compression step.

In other words, the amount of the fuel returned to the suction path 10*d* is increased, and the amount of fuel discharged with the high pressure is reduced. The energization timing to the electromagnetic coil 43 is controlled by a command from the ECU 27.

With the above-described structure, the amount of the fuel discharged with the high pressure can be controlled so as to be an amount required from the internal combustion engine by controlling the energization timing to the electromagnetic coil 43.

Here, the electromagnetic suction valve that is the object of the present invention will be described in detail with reference to cross-sectional views in FIGS. 3 to 5 and a timing chart of FIG. 6.

Figure 3:
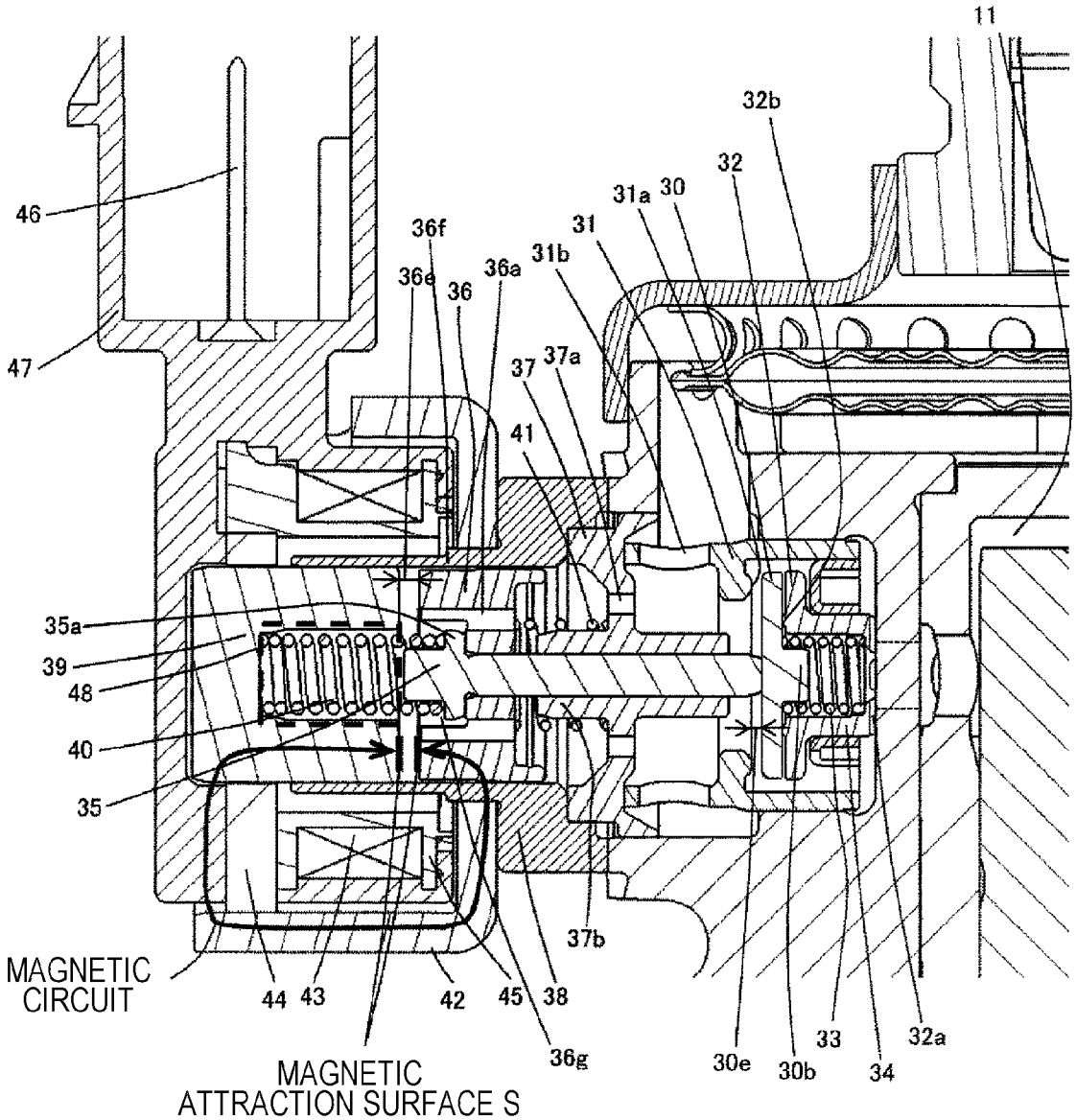
FIG. 3 is an enlarged longitudinal cross-sectional view of an electromagnetic suction valve of the high-pressure fuel supply pump according to the first embodiment and the second embodiment of the present invention and illustrates a state in which the electromagnetic suction valve is in an opened state.

FIG. 3 is an enlarged view of the electromagnetic suction valve 300 and illustrates a state in which the electromagnetic coil 43 is not energized and the pressure in the pressurizing chamber 11 (the pressure pumped by the feed pump 21) is low. In this state, the suction step and the return step are performed.

Figure 4:
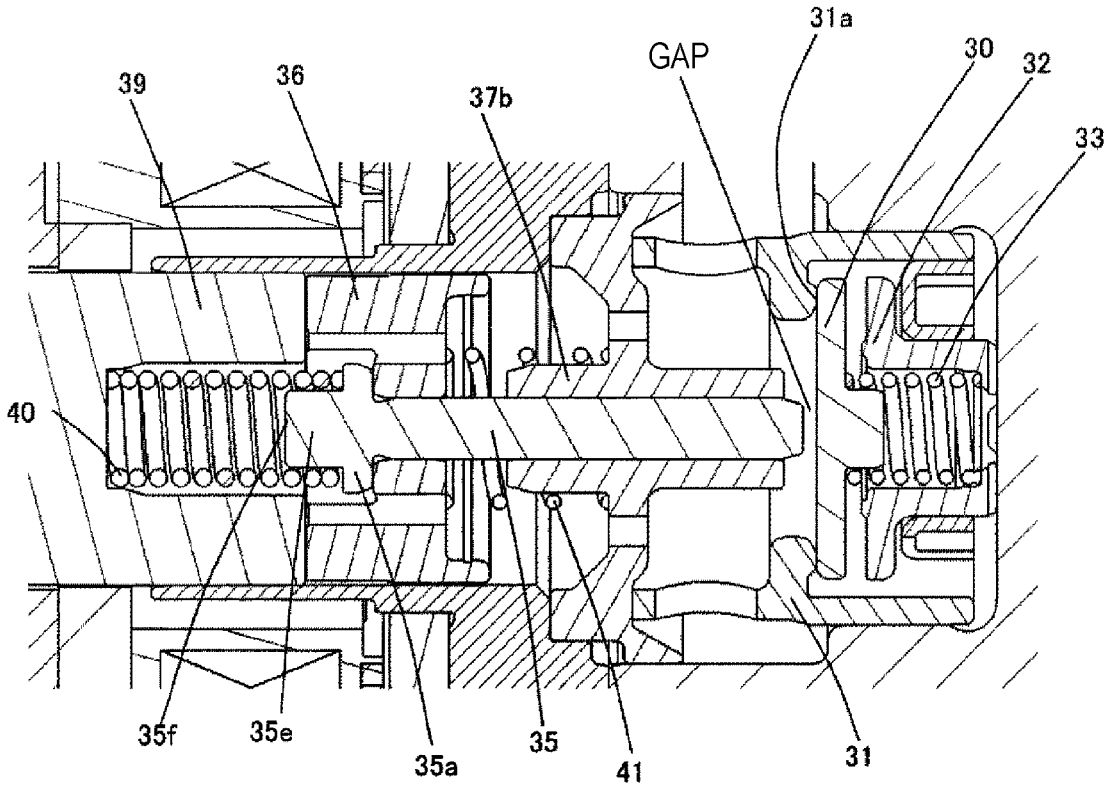
FIG. 4 is an enlarged longitudinal cross-sectional view of the electromagnetic suction valve of the high-pressure fuel supply pump according to the first embodiment and the second embodiment of the present invention and illustrates an initial state in which the electromagnetic suction valve is closed and the electromagnetic suction valve is energized.

FIG. 4 is an enlarged view of the electromagnetic suction valve 300 and illustrates a state in which: the electromagnetic coil 43 is energized and an anchor 36 provided as a movable part contacts a second core 39 by electromagnetic attraction force; and the suction valve 30 is closed.

Figure 5:
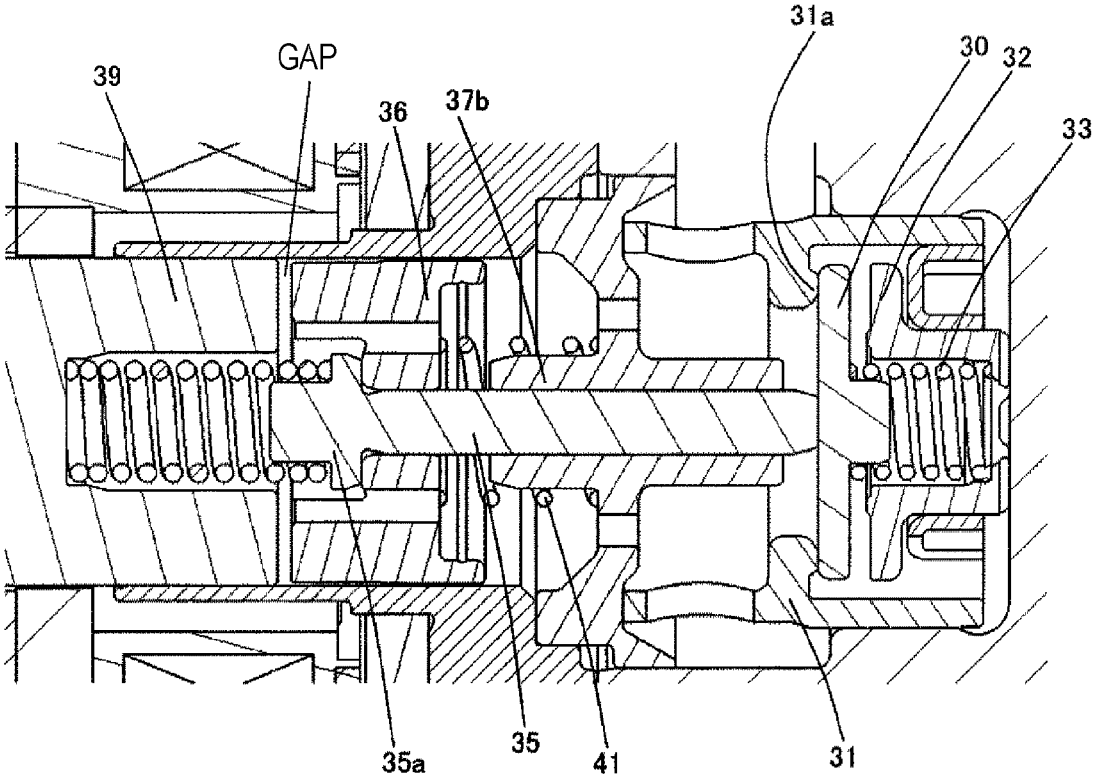
FIG. 5 is an enlarged longitudinal cross-sectional view of the electromagnetic suction valve of the high-pressure fuel supply pump according to the first embodiment and the second embodiment of the present invention and illustrates a later state in which the electromagnetic suction valve is closed state and energization to the electromagnetic suction valve is cut off.

FIG. 5 is an enlarged view of the electromagnetic suction valve 300 and illustrates a state in which energization to the electromagnetic coil 43 is cut off in a state in which the suction valve is closed after the pressure in a pump chamber is sufficiently increased. A suction valve section includes the suction valve 30, a suction valve seat 31, a suction valve stopper 32, the suction valve biasing spring 33, and a suction valve holder 34.

The suction valve seat 31 has a cylindrical shape, includes a seat part 31*a* in an axial direction on an inner periphery side and two or more suction path parts 31*b* radially around an axis of the cylinder, and an outer periphery cylindrical surface thereof is press-fitted and held by the pump main body 1. The suction valve holder 34 has claws in two or more radial directions, and an outer periphery side of each of the claws is coaxially engaged and held on the inner periphery side of the suction valve seat 31. Additionally, the suction stopper 32 having a cylindrical shape and having one end formed in a collar shape is press-fitted and held at an inner periphery cylindrical surface of the suction valve holder 34.

The suction valve biasing spring 33 is disposed on an inner periphery side of the suction valve stopper 32 at a narrow diameter part in order to coaxially and partly stabilize one end of the spring, and the suction valve 30 is formed between the suction valve seat part 31*a* and the suction valve stopper 32 with the suction valve biasing spring 33 being engaged in a valve guide part 30*b*. The suction valve biasing spring 33 is a compression coil spring and is installed such that biasing force acts in a direction in which the suction valve 30 is pressed against the suction valve seat part 31*a*. The suction valve biasing spring is not limited to the compression coil spring and may be any spring as far as biasing force can be obtained, and may be a leaf spring having biasing force integrated with the suction valve.

Since the suction valve section has the above-described structure, the fuel having passed through the suction path 31*b* and entered the inside passes between the suction valve 30 and the seat part 31*a*, passes between the outer periphery side of the suction valve 30 and the claws of the suction valve holder 34, and passes through the pump main body 1 and the path of the cylinder, and the fuel is made to flow into the pump chamber in the suction step of the pump. Furthermore, in the discharge step of the pump, the suction valve 30 contacts and seals the suction valve seat part 31*a*, thereby exerting a function of a check valve to prevent the fuel from flowing back to an inlet side of the fuel.

A path 32*a* is provided in order to smoothen movement of the suction valve 30 and release a liquid pressure on the inner periphery side of the suction valve stopper in accordance with movement of the suction valve. An axial movement amount 30*e* of the suction valve 30 is regulated by the suction valve stopper 32 to a finite extent. When the movement amount is too large, the mentioned backflow amount is increased due to delayed response when the suction valve 30 is closed, and performance of the pump is degraded. Such regulation of the movement amount can be determined by an axial shape dimension and a press-fitted position of each of the suction valve seat 31*a*, suction valve 30, and suction valve stopper 32.

An annular protrusion 32*b* is provided in the suction valve stopper 32 to reduce contact area with the suction valve stopper 32 in a state where the suction valve 32 is opened. This is to facilitate separation of the suction valve 32 from the suction valve stopper 32 when the suction valve is shifted from opened state to the closed state, that is, to improve valve closing responsiveness. In a case of not having the annular protrusion, that is, in a case where the contact area is large, large squeezing force acts between the suction valve 30 and the suction valve stopper 32, and the suction valve 30 is hardly separated from the suction valve 32.

Since the suction valve 30, suction valve seat 31*a*, and suction valve stopper 32 repeatedly collide with each other during actuation, a material obtained by applying heat treatment to martensitic stainless steel provided with high strength, high hardness, and excellent corrosion resistance is used. Considering corrosion resistance, an austenitic stainless steel material is used for the suction valve spring 33 and the suction valve holder 34.

Next, a solenoid mechanism section will be described. The solenoid mechanism section includes: the rod 35 and the anchor 36 which are the movable parts; a rod guide 37, a first core 38, a second core 39 which are fixed parts; the rod biasing spring 40; and an anchor biasing spring 41.

The rod 35 and the anchor 36 provided as the movable parts are formed as separate members. The rod 35 is held slidably in the axial direction on an inner periphery side of the rod guide 37, and an inner periphery side of the anchor 36 is held slidably on an outer periphery side of the rod 35. In other words, both of the rod 35 and the anchor 36 are axially slidable within a range geometrically regulated.

The anchor 36 has one or more through holes 36*a* penetrating the anchor in a component axial direction and eliminates, as much as possible, restriction of movement caused by a pressure difference between front and back of the anchor in order that the anchor 36 can be smoothly moved in the axial direction in the fuel.

The rod guide 37 is radially inserted into an inner Periphery side of a hole where the suction valve is inserted in the pump main body 1, and is axially made to abut on one end of the suction valve seat and disposed in a manner interposed between the pump main body 1 and the first core 38 fixed to the pump main body 1 by welding.

Similar to the anchor 36, the rod guide 37 is also provided with a through hole 37*a* penetrating the rod guide in the axial direction such that the pressure of the fuel chamber on the anchor side does not hinder movement of the anchor in order that the anchor can be smoothly moved.

The first core 38 has a thin-walled cylindrical shape on a side opposite to the portion welded to the pump main body, and the second core 39 is inserted into and fixed to an inner periphery side thereof by welding. The rod biasing spring 40 is disposed on the inner periphery side of the second core 39 while using a narrow diameter part as a guide, the rod 35 contacts the suction valve 30, and applies biasing force in a direction to separate the suction valve from the suction valve seat part 31*a,* that is, an opening direction of the suction valve.

The anchor biasing spring 41 is disposed at a position to apply biasing force to the anchor 36 in a direction of a rod collar part 35*a* while keeping an end inserted into a guide part 37*b* provided on a center side of the rod guide 37 and having a cylindrical diameter. A movement amount 36*e* of the anchor 36 is set larger than the movement amount 30*e* of the suction valve 30. This is to surely close the suction valve 30.

Since the rod 35 and the rod guide 37 slide against each other and the rod 35 repeatedly collides with the suction valve 30, a material obtained by applying heat treatment to martensitic stainless steel is used considering hardness and corrosion resistance. Magnetic stainless steel is used for the anchor 36 and the second core 39 in order to form a magnetic circuit, and respective collision surfaces of the anchor 36 and second core 39 are subjected to surface treatment in order to improve hardness. Particularly, hard Cr plating or the like is used, but not limited thereto. Austenitic stainless steel is used for the rod biasing spring 40 and the anchor biasing spring 41, considering corrosion resistance.

Three springs are formed in the suction valve section and the solenoid mechanism section. The suction valve biasing spring 33 formed in the suction valve section, and the rod biasing spring 40 and the anchor biasing spring 41 formed in the solenoid mechanism section are provided. In present embodiment, a coil spring is used for each of all of these springs, but any spring can be used as far as biasing force can be obtained.

A force relation between these three springs is represented by the following Expression.

Force of rod biasing spring 40>Force of anchor biasing spring 41+Force of suction valve biasing spring 33+Closing force of suction valve by fluid  Expression (1)

According to this relation, due to force of each of the springs, the rod 35 has force f1 applied in the direction to separate the suction valve 30 from the suction valve seat part 31*a,* that is, the valve opening direction during no-energization. According to Expression (1), f1 is as follows.

*f*1=Force of rod biasing spring−(Force of anchor biasing spring+Force of suction valve biasing spring+Closing force of suction valve by fluid)  Expression (2)

Next, a structure of a coil section will be described. The coil section includes a first yoke 42, the electromagnetic coil 43, a second yoke 44, a bobbin 45, a terminal 46, and a connector 47. The coil 43 in which a copper wire is wound around the bobbin 45 multiple times is disposed in a manner surrounded by the first yoke 42 and the second yoke 44, and fixed integrally with the connector 47 that is a resin member by molding. One end of each of two terminals 46 is connected to each of both ends of the copper wire of the coil in an energizable manner. The terminals 46 are also molded integrally with the connector 47, and a remaining end of each of terminals is connectable to an engine control unit side.

In the coil section, a hole part at a center part of the first yoke 42 is press-fitted and fixed to the first core 38. At this point, an inner diameter side of the second yoke 44 contacts or comes close to the second core 39 with a slight clearance.

Both of the first yoke 42 and the second yoke 44 are formed of a magnetic stainless steel material considering corrosion resistance in order to construct a magnetic circuit, and a resin having high strength and heat resistance is used for the bobbin 45 and the connector 47 considering strength properties and heat resistance properties. Copper is used for the coil 43, and metal plated brass is used for the terminals 46.

Since the solenoid mechanism section and the coil section have the above-described structure, the magnetic circuit is formed of the first core 38, first yoke 42, second yoke 44, second core 39, and anchor 36 as indicated by arrows in FIG. 3, and when current is applied to the coil, electromagnetic force is generated between the second core 39 and the anchor 36, and force to attract each other is generated. In the first core 38, an axial portion where mutual attraction force is generated between the second core 39 and the anchor 36 is formed as thin as possible, and therefore, the electromagnetic force can be efficiently obtained because almost all of magnetic fluxes pass between the second core 39 and the anchor 36.

When the electromagnetic force exceeds the mentioned f1, it is possible to perform a motion by which the anchor 36 that is the movable part is attracted to the second core 39 together with the rod 35, and also, the core 39 and the anchor 36 can contact each other and continue contacting each other.

In the following, operation and effects will be described in detail with reference to FIGS. 3 to 5 and the timing chart in FIG. 6.

«Suction Step»

When the plunger 2 starts descending from a top dead center, the pressure inside the pressurizing chamber is rapidly decreased from a high-pressure state of a level of, for example, 20 MPa, and the rod 35, anchor 36, and suction valve 30 are moved in an opening direction of the suction valve 30 by the above-described force f1. When the suction valve 30 is opened, the fuel having flown into an inner diameter side of the valve seat 31 from the path 31*b* of the suction valve seat starts to be sucked into the pressurizing chamber.

The suction valve 30 collides with the suction valve stopper 32, and the suction valve 30 is stopped at that position. Similarly, the rod 35 is also stopped at a position where a tip of the rod contacts the suction valve 30 (valve open position of the plunger rod in FIG. 6).

The anchor 36 is also moved in the opening direction of the suction valve 30 at the speed almost same as that of the rod 35. However, as indicated by A in FIG. 6, the anchor tries to continue being moved by inertial force even after the rod 35 contacts the suction valve 30 and is stopped. However, anchor biasing spring 41 overcomes the inertia force, the anchor 36 is moved again in the direction approaching the second core 39, and the anchor 36 can be stopped at a position where the anchor is pressed against and contacts the rod collar part 35*a* (valve open position of the anchor in FIG. 6). A state indicating the position of each of the anchor 36, rod 35, and suction valve 30 at this point is the state illustrated in FIG. 3.

Figure 6:
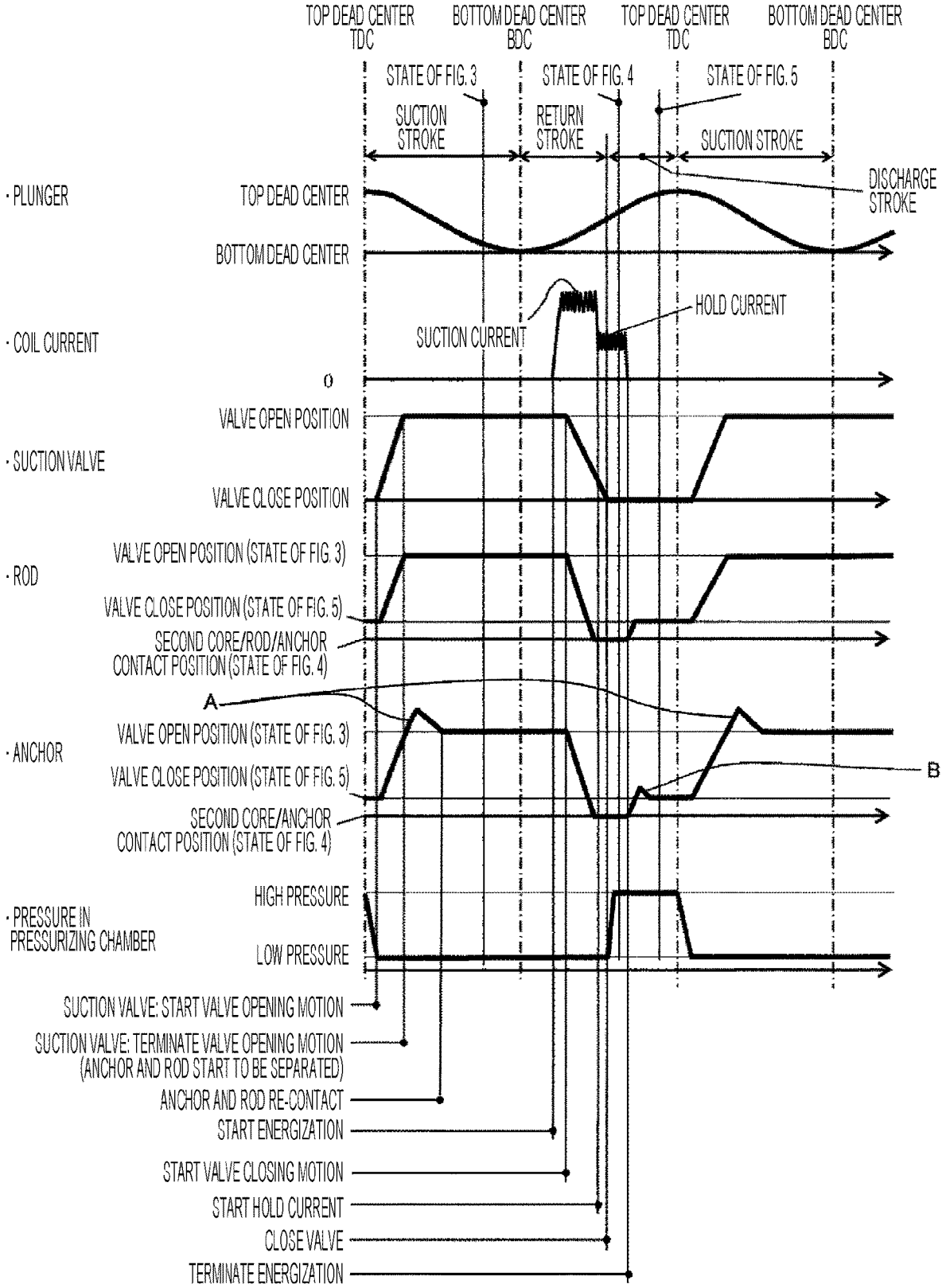
FIG. 6 is a timing chart illustrating operation in each of a plunger and the electromagnetic suction valve of the high-pressure fuel supply pump according to the first embodiment and the second embodiment of the present invention.
Figure 7:
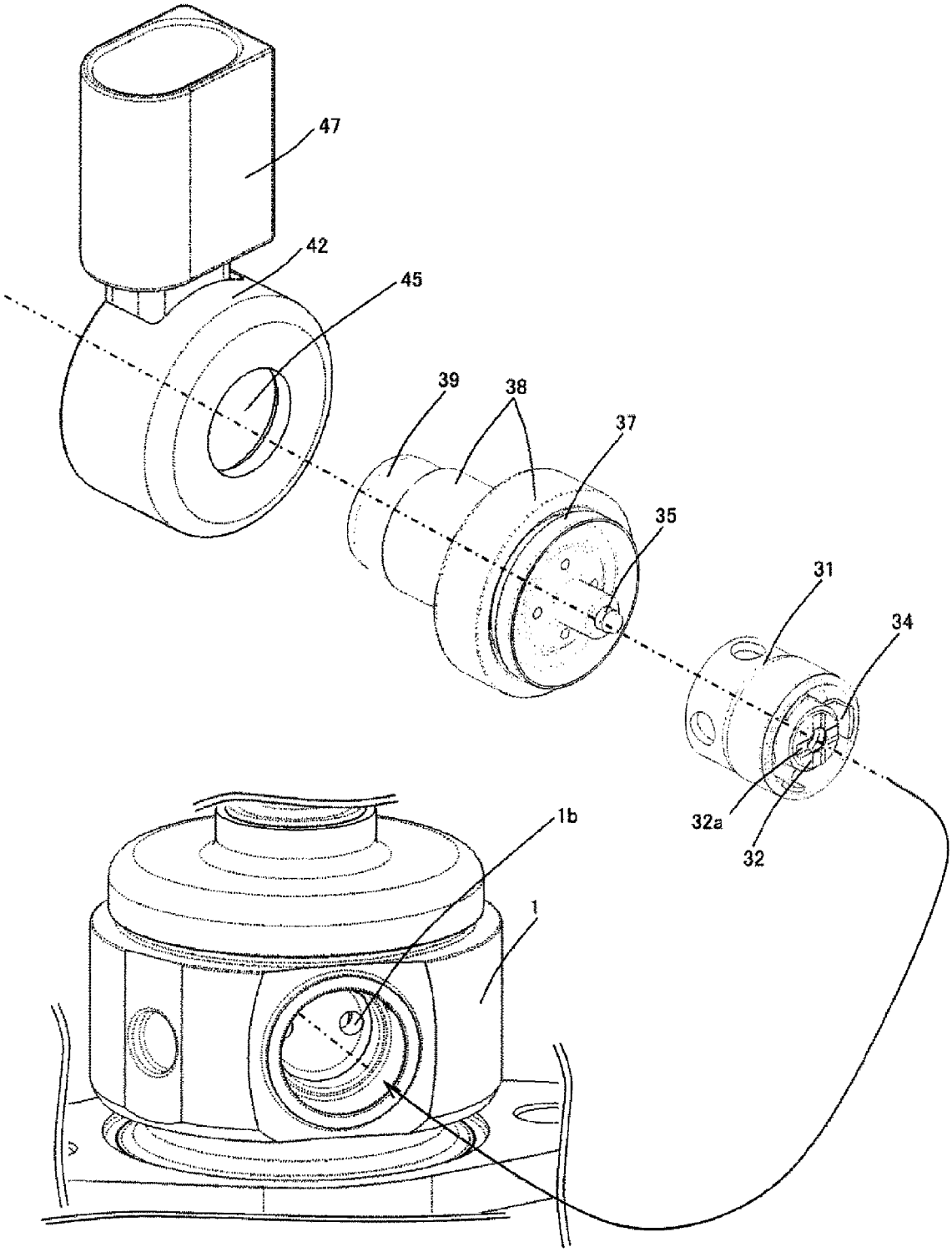
FIG. 7 is an exploded perspective view of the electromagnetic suction valve of the high-pressure fuel supply pump according to the first embodiment and the second embodiment of the present invention.

In the above description and FIG. 6, it is described that the rod 35 and the anchor 36 are completely separated from each other at the part indicated by A, but the rod 35 and the anchor 36 may remain contacting each other. In other words, a load acting on the contact part between the rod collar part 35*a* and the anchor 36 is reduced after the motion of the rod is stopped, and when the load becomes zero, the anchor 36 starts to be separated from the rod, but the load does not necessarily become zero, and may be setting force of the anchor biasing spring 41 while remaining a slight load.

When the suction valve 30 collides with the suction valve stopper 32, there is a problem of abnormal noise that is an important characteristic as a product. A level of the abnormal noise depends on the magnitude of energy at the time of collision, but since the rod 35 and the anchor 36 are formed in the separate bodies, the energy colliding with the suction valve stopper 32 is generated by mass of the suction valve 30 and mass of the rod 35. In other words, since the mass of the anchor 36 does not contribute to collision energy, the problem of abnormal noise is reduced by forming the rod 35 and the anchor 36 in the separate bodies.

Even though the rod 35 and the anchor 36 are formed in the separate bodies, in a case where the anchor biasing spring 41 is not provided, the anchor 36 continues being moved by the inertial force in the opening direction of the suction valve 30 and collides with the center bearing part 37*b* of the rod guide 37, and there is the problem that abnormal noise is generated at a part different from the collision part. Besides the problem of abnormal noise, collision causes not only abrasion, deformation, and the like of the anchor 36 and the rod guide 37 but also generation of a metallic foreign matter due to the abrasion, and a bearing function may be impaired by such a foreign matter caught in the sliding part and deformed, and as a result, the function of the suction valve solenoid mechanism may be impaired.

Additionally, in the case where the anchor biasing spring 41 is not provided, the anchor is excessively separated from the core 39 by the inertial force (part A in FIG. 6), and therefore, there is a problem that necessary electromagnetic attraction force cannot be obtained when current is applied to the coil section in order to shift the return step to the discharge step that is a post-step in terms of operation time. In the case where the necessary electromagnetic attraction force cannot be obtained, there is a serious problem that the fuel to be discharged from the high-pressure pump cannot be controlled at a desired flow rate.

Therefore, the anchor biasing spring 41 has an important function to prevent occurrence of the above-described problems. After the suction valve 30 is opened, the plunger 2 further descends and reaches a bottom dead center. During this time, the fuel continues flowing into the pressurizing chamber 11, and this step is the suction step.

«Return Step»

The plunger 2 having descended to the bottom dead center proceeds to the ascending step. The suction valve is kept stopped in the open state by the mentioned f1, and a direction of the fluid passing through the suction valve becomes the opposite direction. In other words, while the fuel flows into the pressurizing chamber from the suction valve seat path 31*b* in the suction step, the fuel is returned from the pressurizing chamber in a direction of the suction valve seat path 31*b* when the step shifted to the ascending step. This step is called the return step.

In this return step, closing force of the suction valve by the returned fluid is increased and the mentioned force f1 becomes small at the time of high engine speed, that is, under a condition that an ascending speed of the plunger 2 is high Under this condition, in a case where the setting force of each of the springs is set incorrectly and the f1 becomes a negative value, the suction valve 30 is unintentionally closed. Since discharge is performed at a flow rate larger than the desired discharge flow rate, a pressure inside the fuel pipe is increased to a desired pressure or higher, thereby affecting combustion control of the engine. Therefore, it is necessary to set the force of each of the springs such that the force f1 can keep a positive value under the condition that the ascending speed of the plunger 2 is the highest.

«Shift State from Return Step to Discharge Step»

Considering generation of electromagnetic force and delay in closing the suction valve, current is applied to electromagnetic coil 43 at the time earlier than desired discharge time, and magnetic attraction force acts between the anchor 36 and the second core 39. As for this current, current having the magnitude enough to overcome the force f1 is needed to be applied. When the magnetic attraction force overcomes the force f1, the anchor 36 starts to be moved toward the second core 39. The rod 35 having the collar part 35*a* that is in contact with the anchor is also moved in the axial direction along with movement of the anchor 36, and the suction valve 30 is started to be closed by the force of the suction valve biasing spring 33 and fluid force, mainly, due to decrease in a static pressure caused by a flow speed at which the fluid passes through the seat part from the pressurizing chamber side.

In a case where the anchor 36 and the second core 39 are excessively separated from each other more than a prescribed distance when the current is applied to the electromagnetic coil 43, in other words, in a case where the anchor 36 continues to be in the state of A even after the "valve open position" in FIG. 6, the magnetic attraction force is too weak to overcome the force f1, and there is a problem that it takes a quite a time to move the anchor to the second core 39 side or the anchor cannot be moved.

The anchor biasing spring 41 is provided in order to prevent such a problem. In a case where the anchor 36 cannot be moved to the second core 39 at desired timing, the discharge step cannot be started because the suction valve is kept opened even at the timing desired to perform discharging. In short, that is, there is concern that desired engine combustion cannot be performed because a necessary discharge amount cannot be obtained. Therefore, the anchor biasing spring 41 has an important function to prevent the abnormal noise problem that may occur in the suction step and also to prevent the problem that the discharge step cannot be started.

The suction valve 30 that has been started to be moved is made to the closed state by colliding with the seat part 31*a* and being stopped. When the valve is closed, a cylinder inner pressure is rapidly increased, and therefore, the suction valve 30 is strongly pressed in the closing direction by the cylinder inner pressure with the force larger than the force f1, and the closed state is started to be kept.

Here, a description will be provided for a problem of erosion that is the problem of the present embodiment and may occur in the solenoid mechanism section. In a case where space volume between the anchor 36 and the second core 39 is rapidly reduced when the current is applied to the coil and the anchor is attracted to the second core, fluid existing in the space loses a place to go. Therefore, the fluid is swept to the outer periphery side of the anchor with a fast flow, collides with the thin-walled part of the first core, and erosion may be caused by this energy. Additionally, the swept fluid passes through the outer periphery of the anchor and flows to the rod guide side, but since the path on the outer periphery side of the anchor is narrow, the flow speed becomes high. Then, cavitation may occur due to rapid decrease in the static pressure, and cavitation erosion may occur at the thin-walled part of the first core.

To avoid such problems, one or more of the axial through holes 36*a* are provided on the anchor center side. The reason is to allow the fluid in the space to pass through the through holes 36*a* when the anchor 36 is attracted toward the second core 39 side such that the fluid does not pass through the narrow path on the outer periphery side of the anchor as much as possible.

In the present embodiment, it is directed to reducing occurrence of cavitation that may cause the cavitation erosion. Since the fuel path is narrow and the flow is linear at a place where the flow speed of the fuel is high, the flow separation tends to occur at a shape having a steep angle, and as a result, the pressure is dropped, and such a state mainly causes the cavitation. Therefore, the flow speed can be gradually decreased and pressure drop can be suppressed by moderately widening the flow passage from the narrow fuel path, and as a result, the above-described problem of erosion can be solved.

In a case where the anchor 36 and the rod 35 are integrally formed, there is another phenomenon that may cause the above-described problem. When the current is applied to the coil under the condition that engine speed is high, that is, the ascending speed of the plunger is high, the closing force of the suction valve 30 by the fluid having an extremely fast speed is added as additional force to move the anchor 36 toward the second core 39, and the rod 35 and the anchor 36 rapidly approach the second core 39, and therefore, the fluid in the space is pushed away with the even faster speed, and the problem of erosion becomes more serious. In a case where the volume of the through hole 36*a* of the anchor 36 is not sufficient, the problem of erosion cannot be solved.

In the present embodiment, since the anchor 36 and the rod 35 are formed in the separate bodies, even in the case where the closing force of the suction valve 30 is applied to the rod 35, only the rod 35 is pushed away toward the second core 39 side and moved to the second core 39 side only by normal electromagnetic attraction force while leaving the anchor 36 behind. In other words, the space is not rapidly reduced, and occurrence of the problem of erosion can be prevented.

As described above, the disadvantages of forming the anchor 36 and the rod 35 in the separate bodies are: incapability of obtaining desired magnetic attraction force, generation of abnormal noise, and degradation of the functions, however; the disadvantages can be eliminated by installing the anchor biasing spring 41.

«Discharge Step»

Immediately after termination of the return step that is a step from when the plunger is shifted to the ascending step from the bottom dead center and the current is applied to the coil 43 at the desired timing until when the suction valve 30 is closed, the pressure inside pressurizing chamber is rapidly increased and the step proceeds to the discharge step. After the discharge step, the current applied to the coil is cut off because it is desirable to reduce the power applied to the coil from the viewpoint of power saving. With no application of electromagnetic force, the anchor 36 and the rod 35 are moved in a direction away from the second core 39 by resultant force of the rod biasing spring 40 and the anchor biasing spring 41. However, since the suction valve 30 is in the closed position by strong closing force, the rod 35 is stopped at the position where the rod collides with the suction valve 30 in the closed state. In other words, the movement amount of the rod at this point is 36*e*-30*e*.

Thus, the discharge step to discharge the fuel is performed, and the suction valve 30, rod 35, and anchor 36 are in the state illustrated in FIG. 5 immediately before the subsequent suction step. When the plunger reaches the top dead center, the discharge step is terminated and the suction step is started again.

Thus, the fuel guided to the low-pressure fuel suction port 10*a* is pressurized to a high pressure by the reciprocating motion of the plunger 2 in the pressurizing chamber 11 of the pump main body 1 provided as the pump main body, and it is possible to provide the high-pressure pump suitable for pumping the fuel from the fuel discharge port 12 to the common rail 23.

As illustrated in an enlarged view of an anchor rod

Figure 9:
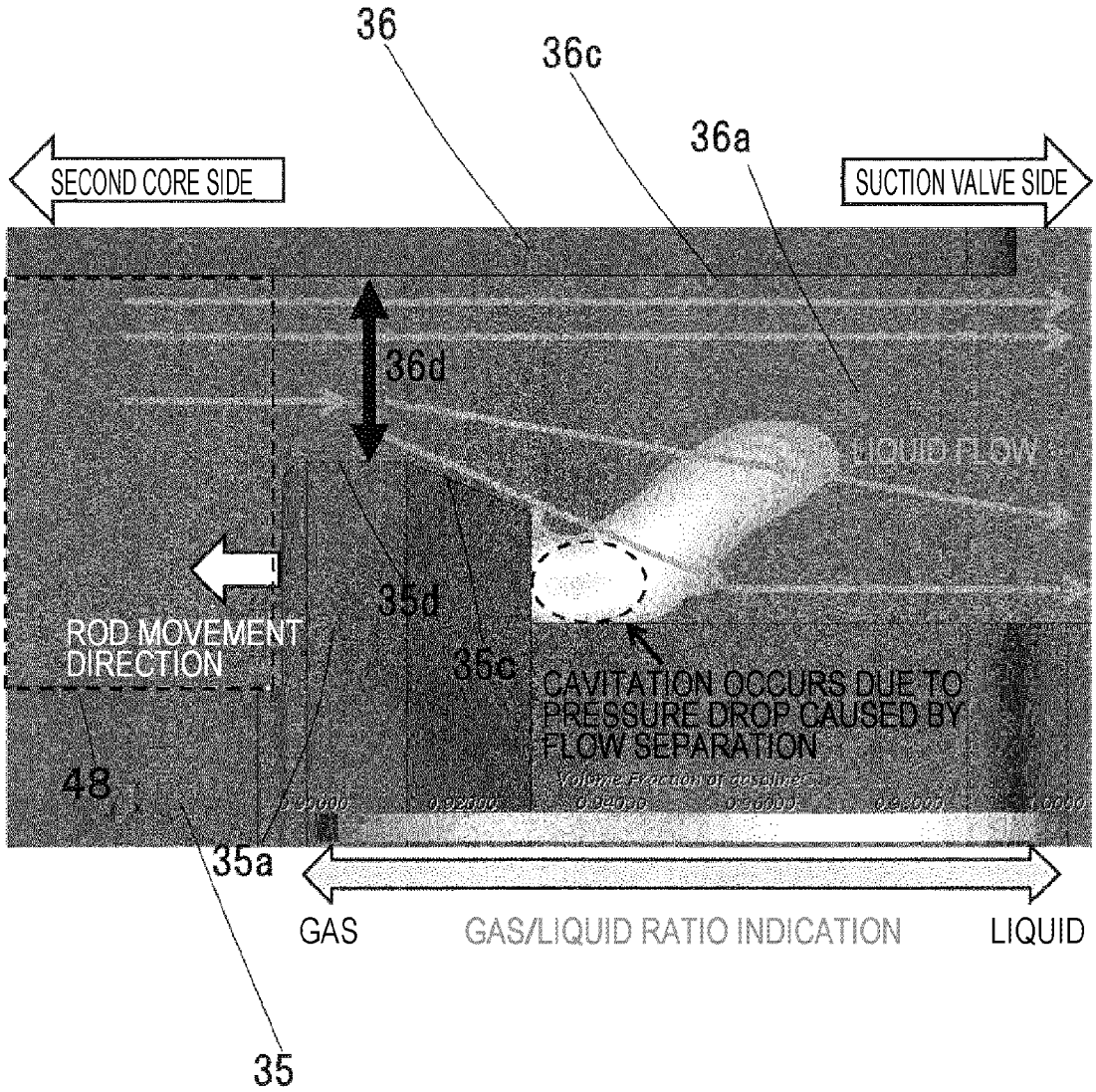
FIG. 9 is a view of gas phase volume fraction of a rod protrusion part of the high-pressure fuel supply pump according to the first embodiment of the present invention.

Protrusion part in FIG. 9, the high-pressure pump of the present embodiment is formed such that the flow passage area between an outer periphery part 35*d* of the protrusion part 35*a* and an inner periphery part 36*c* of the anchor 36 becomes the smallest in a region from a spring space 48 to the fuel path 36*a* formed in the anchor 36. Additionally, the protrusion part 35*a* is characterized in being formed with a tapered section 35*c* to broaden the flow passage area, and this tapered section is included in the outer periphery part 35*d* and has an outer diameter reduced toward the fuel path 36*a* from a portion 36*d* having the smallest flow passage area located in a region with the inner periphery part 36*c*.

Consequently, when a liquid flow is generated along with movement of the anchor 36 by opening/closing of the suction valve 30 in FIG. 4, the flow speed is gradually decreased and pressure drop is suppressed because the flow passage is gradually broadened after the fuel passes through the smallest flow passage area 36*d*, and as a result, a flow separation part is reduced, thereby contributing to suppression of cavitation.

Additionally, according to the cross-sectional view of the solenoid section of the high-pressure fuel pump in FIG. 3, the high-pressure fuel supply pump having the above-described structure is characterized in that the fuel in the spring space 48 where the spring 40 is disposed is made to flow to the suction valve 30 side via the fuel path 36*a* and a fuel path 36*f* in the case where the anchor 36 is moved toward the second core 39. As a result, the fuel can be moved by operation of the anchor.

Furthermore, according to the enlarged view of the anchor rod protrusion part in FIG. 9, the high-pressure fuel supply pump having the above-described structure is characterized in that the tapered section 35*c* has the outer diameter gradually reduced toward the fuel path 36*a* and broadens the flow passage area. Consequently, since the flow passage area is broadened after the fuel passes through the smallest flow passage area 36*d*, the flow speed of the fuel is decreased, and this contributes to reduction of the flow separation part.

Figure 10:
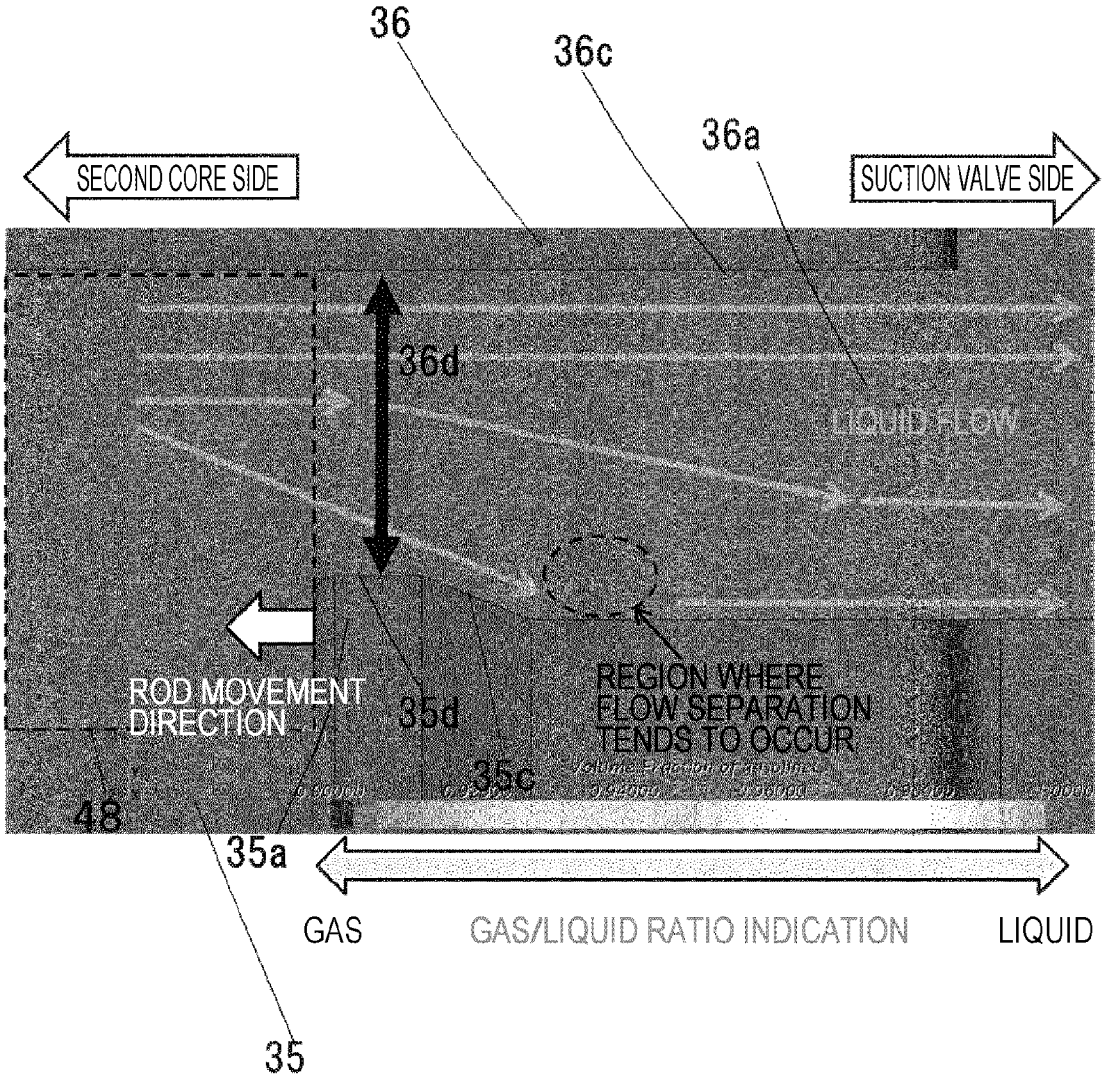
FIG. 10 is a view of the gas phase volume fraction diagram of the rod protrusion part of the high-pressure fuel supply pump according to the first embodiment of the present invention in which a countermeasure shape recited in claim 5 is implemented.

Furthermore, as illustrated in an enlarged view of the anchor rod protrusion part in FIG. 10, the high-pressure fuel supply pump having the above-described structure of the present embodiment is characterized in that the taper 35*c* is engaged with the anchor 36 more on the inner periphery side than the fuel path 36*a* of the anchor 36. Consequently, the flow passage area is broadened after the fuel passes through the smallest flow passage area 36*d*, and this contributes to decrease in the flow speed.

Additionally, in the high-pressure fuel supply pump having the above-described structure, the structure of FIG. 9 can also contribute to suppression of cavitation as described above. However, even in structure of FIG. 9, there is a place where cavitation may occur due to pressure drop caused by flow separation. Therefore, the embodiment of the present invention illustrated in FIG. 10 is characterized in that the tapered section 35*c* is formed such that an end part on the fuel path side of the tapered section is located at a position corresponding to an innermost periphery side of the fuel path 36*a*. In other words, there is no stepped part in a region from the tapered section 35*c* to the rod part as illustrated in FIG. 9, and the tapered section 35*c* and the rod part are smoothly connected. Consequently, since the flow passage area of the smallest flow passage area part 36*d* is broadened, the flow speed of the fuel is decreased, and this contributes to suppression of cavitation by reduction of the flow separation part.

Furthermore, according to the cross-sectional view of the solenoid section of the high-pressure fuel supply pump when the suction valve is opened in FIG. 3, the high-pressure fuel supply pump having the above-described structure is characterized in that the rod 35 includes a cylindrical part 35*e* having a diameter smaller than that of the protrusion part 35*a* and extending toward the spring 40 side, and the cylindrical part has an end part 35*f* formed at a position corresponding to an end face of the second core 39 facing the anchor 36. This contributes to prevention of magnetic leakage from the cylindrical part to the second core.

Additionally, according to the cross-sectional view of the solenoid section when the suction valve is closed in FIG. 3, the high-pressure fuel supply pump having the above-described structure is characterized in that the rod 35 includes the cylindrical part 35*e* having the diameter smaller than that of the protrusion part 35*a* and extending toward the spring 40 side, the protrusion part and the cylindrical part are disposed on an inner periphery side of a recessed part 36*g* formed in the anchor, and the cylindrical part 35*e* is formed such that the end part 35*f* of the cylindrical part formed at the position corresponding to the end face of the second core 39 facing the anchor 36.

Furthermore, according to the cross-sectional view of the solenoid section when the suction valve is closed in FIG. 4, the high-pressure fuel supply pump having the above-described structure is characterized in that the rod 35 includes the cylindrical part 35*e* having the diameter smaller than that of the protrusion part 35*a* and extending toward the spring 40 side, the protrusion part 35*a* and the cylindrical part 35*e* are disposed on the inner periphery side of the recessed part 36*g* formed in the anchor 36, and the spring 40 is held by being wounded around the cylindrical part 35*e*. Consequently, there is an effect of stabilizing a posture of the spring 40.

Additionally, according to the cross-sectional view of the solenoid section when the suction valve is closed in FIG. 4, the high-pressure fuel supply pump having the above-described structure is characterized in that the spring 40 is wound around the cylindrical part 35*e* 1.5 turns or more. Consequently, there is an effect of stabilizing a posture of the spring 40.

Furthermore, according to the cross-sectional view of the solenoid section when the suction valve is closed in FIG. 4, the high-pressure fuel supply pump having the above-described structure is characterized in that the rod 35 includes the cylindrical part 35*e* having the diameter smaller than that of the protrusion part 35*a* and extending toward the spring 40 side, the fuel path 36*a* of the anchor 36 is formed in a manner overlapping with an inner periphery surface of the recessed part formed in the second core 39 in the movement direction of the anchor 36, and the outer periphery part of the cylindrical part 35*e* is located more on the inner periphery side than the innermost periphery side of the fuel path 36*a*. Consequently, a flow passage through which the fuel in the spring space 48 is moved can be secured.

Additionally, according to the cross-sectional view of the solenoid section when the suction valve is closed in FIG. 4, the high-pressure fuel supply pump having the above-described structure is characterized in that the rod 35 includes the cylindrical part 35*e* having the diameter smaller than that of the protrusion part 35*a* and extending toward the spring 40 side, and the flow passage area between the outer periphery part 35*d* of the protrusion part 35*a* and the inner periphery part of the anchor 36 is smaller than that of the fuel flow passage 36*a* between the cylindrical part 35*e* and the second core 39.

Consequently, since the flow speed in the flow passage between the outer periphery part 35*d* and the inner periphery part of the anchor 36 becomes faster, the flow separation part can be reduced by the taper of the present invention.

As described above, cavitation is more likely to occur in the structure of FIG. 9 than in the structure of FIG. 10. The reasons will be described below. The fuel path inside the anchor 36 is illustrated in FIG. 9, and magnetic attraction force is generated between the anchor 36 and the second core 39 by energizing the electromagnetic coil 43, and the fluid is pushed way by movement of the anchor 36 and the rod 35 toward the second core side, and flow toward the suction valve side through the combustion path 36*a*. At this point, a flow separation part is generated and the pressure drops due to influence of the flow after the fluid passes through the vicinity of the rod protrusion part 35*a*, and cavitation occurs.

In contrast, in FIG. 10, in FIG. 9 illustrating the enlarge view of the anchor rod protrusion part in the present embodiment, flow separation is caused in the vicinity of the rod protrusion part 35*a* when the fluid is pushed away toward the suction valve side due to movement of the rod 35 toward the second core side as described above. On the other hand, in present embodiment, since the protrusion part 35*a* is provided with the taper as illustrated in FIG. 10, the inside of the fuel path is formed smooth without having any step. Consequently, flow separation can be reduced by rectifying the fuel flow, and occurrence of cavitation can be suppressed.

Second Embodiment

Figure 11:
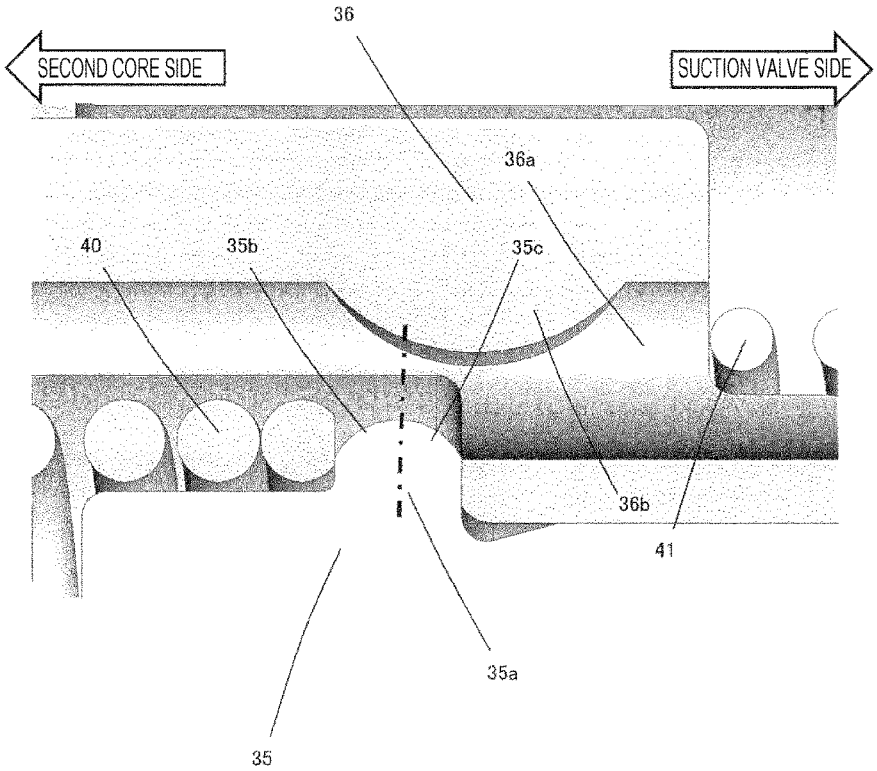
FIG. 11 is a cross-sectional view of the rod protrusion part of the high-pressure fuel supply pump according to the second embodiment of the present invention.

FIG. 11 is an enlarged view of the anchor/anchor rod protrusion part in the present embodiment. As illustrated in a rod protrusion part 35*a*, since the taper is provided in each of a second core side 35*b* and a suction valve side 35*c* of the protrusion part, and therefore, it is possible to reduce a flow separation part generated in the vicinity of the protrusion part along with movement of an anchor at the time of opening/closing the suction valve, and occurrence of cavitation can be suppressed.

As illustrated in FIG. 11, since a taper or a gentle curved surface is provided at the rod protrusion part 35*a* and a protrusion part 36*b* of an anchor is provided, it is possible to reduce the flow separation part generated in the vicinity of the protrusion parts along with movement of a rod 35 at the time of opening/closing the suction valve, and occurrence of cavitation is suppressed

REFERENCE SIGNS LIST

1 pump main body
2 plunger
6 cylinder
7 seal holder
8 discharge valve mechanism
9 pressure pulsation reduction mechanism
10*a* low-pressure fuel suction port

11 pressurizing chamber
12 fuel discharge port
13 plunger seal
30 suction valve
31 suction valve seat
33 suction valve spring
35 rod
35*a* rod protrusion part
35*b* second core side of rod protrusion part
35*c* suction valve side of rod protrusion part
35*d* outer diameter of rod protrusion part
36 anchor
36*a* fuel path
36*b* anchor protrusion part
36*c* inner periphery part of anchor
36*d* flow passage area smallest part
36*f* fuel path (side gap part)
38 first core
39 second core
40 rod biasing spring
41 anchor biasing spring
43 electromagnetic coil
48 spring space
300 electromagnetic suction valve

The invention claimed is:

1. A high-pressure fuel supply pump comprising:

a suction valve provided on a suction side of a pressurizing chamber;

an engagement member having a protrusion part which protrudes toward an outer periphery side and biases the suction valve by use of force of a spring;

a stator which generates magnetic attraction force; and a movable element which is sucked by the magnetic attraction force and drives the engagement member toward the stator by being engaged with the protrusion part, wherein flow passage area between an outer periphery part of the protrusion part and an inner periphery part of the movable element is formed smallest in a region from the spring space to a fuel path formed in the movable element, and the protrusion part is further formed with a tapered section which broadens flow passage area, and the tapered section is included in outer periphery part of the protrusion part and has an outer diameter reduced toward the fuel path from a portion having the smallest flow passage area in a region with the inner periphery part.

2. The high-pressure fuel supply pump according to claim 1, wherein the fuel path is formed with a fuel path in which fuel in the spring space where the spring is disposed is made to flow into the pressurizing chamber in a case where the movable elements is moved toward the stator.

3. The high-pressure fuel supply pump according to claim 1, wherein the tapered section is formed such that the outer diameter is gradually reduced toward the fuel path so as to broaden the flow passage area.

4. The high-pressure fuel supply pump according to claim 1, wherein the protrusion part is engaged with the movable element more on an inner periphery side than the fuel path of the movable element.

5. The high-pressure fuel supply pump according to claim 4, wherein the tapered section is formed such that an end part of the tapered section on the side of the fuel path is located at a position corresponding to an innermost periphery side of the fuel path.

6. The high-pressure fuel supply pump according to claim 1, wherein the engagement member has a cylindrical part having a diameter smaller than a diameter of the protrusion part and extending toward the spring side, and the cylindrical part is formed such that an end part of the cylindrical part is located at a position corresponding to an end surface of the stator facing the movable element.

7. The high-pressure fuel supply pump according to claim 1, wherein the engagement member has a cylindrical part having a diameter smaller than a diameter of the protrusion part and extending toward the spring side, and the protrusion part and the cylindrical part are disposed on an inner periphery side of a recessed part formed in the movable element, and the cylindrical part is formed such that an end part of the cylindrical part is located at a position corresponding to an end surface of the stator facing the movable element.

8. The high-pressure fuel supply pump according to claim 1, wherein the engagement member has a cylindrical part having a diameter smaller than a diameter of the protrusion part and extending toward the spring, and the protrusion part and the cylindrical part are disposed on an inner periphery side of a recessed part formed in the movable element, and the spring is held by being wounded around the cylindrical part on the inner periphery side of the recessed part.

9. The high-pressure fuel supply pump according to claim 8, wherein the spring is wound around the cylindrical part 1.5 turns or more.

10. The high-pressure fuel supply pump according to claim 1, wherein the engagement member has a cylindrical part having a diameter smaller than a diameter of the protrusion part and extending toward the spring side, the fuel path of the movable element is formed in a manner overlapping with an inner periphery surface of the recessed part formed in the stator in the movement direction of the movable element, and the outer periphery part of the cylindrical part is located more on the inner periphery side than the innermost periphery side of the fuel path.

11. The high-pressure fuel supply pump according to claim 1, wherein the engagement member has a cylindrical part having a diameter smaller than a diameter of the protrusion part and extending toward the spring side, and the flow passage area between the outer periphery part of the protrusion part and the inner periphery part of the movable element is smaller than a fuel flow passage between the cylindrical part and the stator.

* * * * *